US005507474A

United States Patent [19]

Dody et al.

[11] Patent Number: 5,507,474

[45] Date of Patent: Apr. 16, 1996

[54] LINING FOR MOLTEN METAL HANDLING VESSLES

[75] Inventors: Julie A. Dody, Easton, Pa.; Charles R. Rumpeltin, Jr., Flanders, N.J.

[73] Assignee: Minerals Technologies, INc., New York, N.Y.

[21] Appl. No.: 182,874

[22] Filed: Jan. 13, 1994

[51] Int. Cl.[6] ..... C21B 13/00

[52] U.S. Cl. ..... 266/44; 266/280; 501/84

[58] Field of Search ..... 266/280, 281, 266/286, 44; 501/84

[56] References Cited

U.S. PATENT DOCUMENTS

| | | | |
|---|---|---|---|
| 3,382,082 | 5/1968 | Eubanks et al. | 501/84 |
| 3,574,646 | 4/1971 | Wismer et al. | 501/84 |
| 3,916,047 | 10/1975 | Niesen | 266/280 |
| 4,076,224 | 2/1978 | Duchateau | 266/275 |
| 4,341,561 | 7/1982 | Britt et al. | 501/84 |
| 4,375,516 | 3/1983 | Barrall | 501/84 |
| 4,438,906 | 3/1984 | English | 266/44 |
| 4,469,309 | 9/1984 | Takashima et al. | 266/44 |
| 4,575,439 | 3/1986 | Hintzen et al. | 501/84 |
| 4,750,717 | 6/1988 | Pheasant et al. | 266/286 |
| 4,799,652 | 1/1989 | Daussan et al. | 266/275 |
| 4,998,710 | 3/1991 | Pelton | 266/286 |
| 5,024,423 | 6/1991 | Matsumoto et al. | 266/283 |
| 5,036,029 | 7/1991 | Johnson | 501/121 |
| 5,139,239 | 8/1992 | Eccleston | 266/275 |
| 5,188,794 | 2/1993 | Daussan et al. | 266/44 |
| 5,217,929 | 6/1993 | Taft | 266/280 |

FOREIGN PATENT DOCUMENTS 1364665 8/1974 United Kingdom .

OTHER PUBLICATIONS

Ogneupory, No. 9, pp. 3–7, Sep., 1976, by S. I. Shcheglov et al., "High–Strength Lightweight Refractories Produced By Bloating During Firing".

Science Notebook, by Caleb Guthrie, "It's solid—but lighter than air" (no date).

Article—Jan. 29, 1985, Breakthroughs by Bill Lawren "Ceramic Beer".

*Primary Examiner*—Scott Kastler

*Attorney, Agent, or Firm*—Pennie & Edmonds

[57] ABSTRACT

The invention is directed to a low density material suitable for use as an expendable liner in a molten metal handling vessel such as tundish. The low density materials include a first component having at least one decomposable compound capable of producing gas, a second component having a reactable compound for reacting with the decomposable compound in the presence of water to cause the decomposable compound to generate a gas, and a refractory aggregate. The invention also relates to a method for making the low density material and to the resultant material as well.

28 Claims, 2 Drawing Sheets

LINING FOR MOLTEN METAL HANDLING VESSLES

FIELD OF THE INVENTION

This invention relates to low density linings for molten metal handling vessels such as tundishes.

BACKGROUND OF THE INVENTION

In the continuous casting of molten metals such as steel, molten metal is poured from a ladle into a continuous casting mould via an intermediate vessel called a tundish which acts as a constant head reservoir. The tundish has a metal floor, sidewalls, and one or more outlets set in the floor or sidewall. To protect the metal floor and sidewalls from the molten metal, it is usual to line the floor and sidewalls of the tundish with a relatively permanent lining, often made of bricks or a castable. The tundish additionally may be provided with an inner, expendable lining of refractory. For example, see British patent No. 1,364,665.

While it is desirable for the expendable lining to be highly heat-insulating, it is also desirable for the expendable lining to have substantial resistance to erosion and corrosion by molten metal and slag. However, any change in the lining that improves its heat-insulating properties is usually associated with reduced density which tends to lessen erosion/corrosion resistance.

Various proposals have been made for expendable linings. For example, U.S. Pat. No. 5,139,239 shows forming an expendable lining in a molten metal handling vessel that has an outer metal casing lined with a permanent lining. Portions of the surface of the permanent lining are covered with a removable material. A slurry of refractory material is applied over both the removable material and the remaining exposed portions of the permanent lining. The slurry of refractory material can be applied by spraying, although gunning or trowelling may be used. The removable material may be in the form of consumable material, for example cardboard, strawboard, fiberboard or polystyrene. Alternatively, the removable material may be in the form of a consumable cellular material, e.g. polyurethane foam. The slurry is dried to form the expendable lining.

Traditional expendable liner materials as described above have employed combustible fillers to reduce the density of the formed expendable lining. These filler materials may be organic, inorganic, or synthetic fibers or spheres. The drawbacks to using fillers to reduce the density of the lining material are that the amount of density reduction is limited to the amount of filler added. Also, the temperature required to remove any combustible filler materials can generate undesirable stress in the lining as the combustible materials are oxidized. The filler also can reduce the strength and chemical durability of the resulting lining, and produce undesirable interconnected porosity. The filler can also increase water requirements, thereby necessitating extra drying time and expense, and as well increasing the risk of shrinkage cracking. In addition, the filler may cause handling and flow difficulties.

U.S. Pat. No. 5,188,794 shows a lining obtained by application of burnt dolomite in the form of grains mixed with an organic binder such as a thermosetting resin. After application of the lining material, it is heated to decompose the carbonate and/or the binder of the composition to provide a porous layer.

Although the methods of the art have provided porous materials which are useful as expendable linings such as on vertical surfaces, these methods have required high temperatures to produce a porous lining. Also, these methods often yield undesirable interconnected porosity. A need therefore exists for expendable linings which can be formed without the high temperature requirements of the art, and which avoid interconnected porosity.

SUMMARY OF THE INVENTION

According to the invention, a composition suitable for providing a low density expendable liner is provided. This composition comprises first component which generates a gas such as $SO_2$, $H_2$, or $CO_2$, preferably $CO_2$, when the first component decomposes, and a second component for causing the first component to decompose in the presence of water to generate the gas, and a refractory aggregate. The first component can include compounds such as sodium bicarbonate, calcium carbonate, dolomitic carbonate, barium carbonate, preferably calcium carbonate, to provide a source of $CO_2$. More preferably, the first component includes calcium carbonate in an amount of about 1–5 percent by weight of the composition.

Examples of materials useful as the first component to generate $SO_2$ include but are not limited to aluminum sulfate, and calcium lignosulfonate; examples of materials useful as the first component to generate $H_2$ include but are not limited to metal powders such as Fe-Si alloys of -150 mesh, Al-Si alloys of -20 mesh; Si alloys of -325 mesh; Mg-Al alloys of -200 mesh; and Al alloys of -325 mesh. Combinations of these materials, such as blends of aluminum sulfate and calcium carbonate, to generate a mixture of $CO_2$ and $SO_2$ gases also can be used.

The second component employed in the composition of the invention may be any compound capable of reacting with the first component to cause the first component to generate a gaseous product. Preferably, acidic materials such as aluminum sulfate are useful as the second component, and are present in an amount of about ⅓–⅔ the weight of the first component. A preferred expendable liner composition includes three percent of calcium carbonate as the first component and 1–5 percent of aluminum sulfate as the second component, based on the total weight of the composition.

The invention further relates to a method for producing a low density lining material on a substrate such as the permanent lining of a tundish. The method entails applying the expendable liner composition of the invention to the substrate by methods such as spraying or gunning to produce a green, porous layer on the substrate. The green porous layer readily can be dried and heat treated to yield an expendable liner.

Having briefly summarized the invention, the invention will now be described in detail by reference to the following specification and non-limiting examples. Unless otherwise specified, all percentages are by weight and all temperatures are in degrees Celsius.

DETAILED DESCRIPTION OF THE INVENTION

Figure 1:
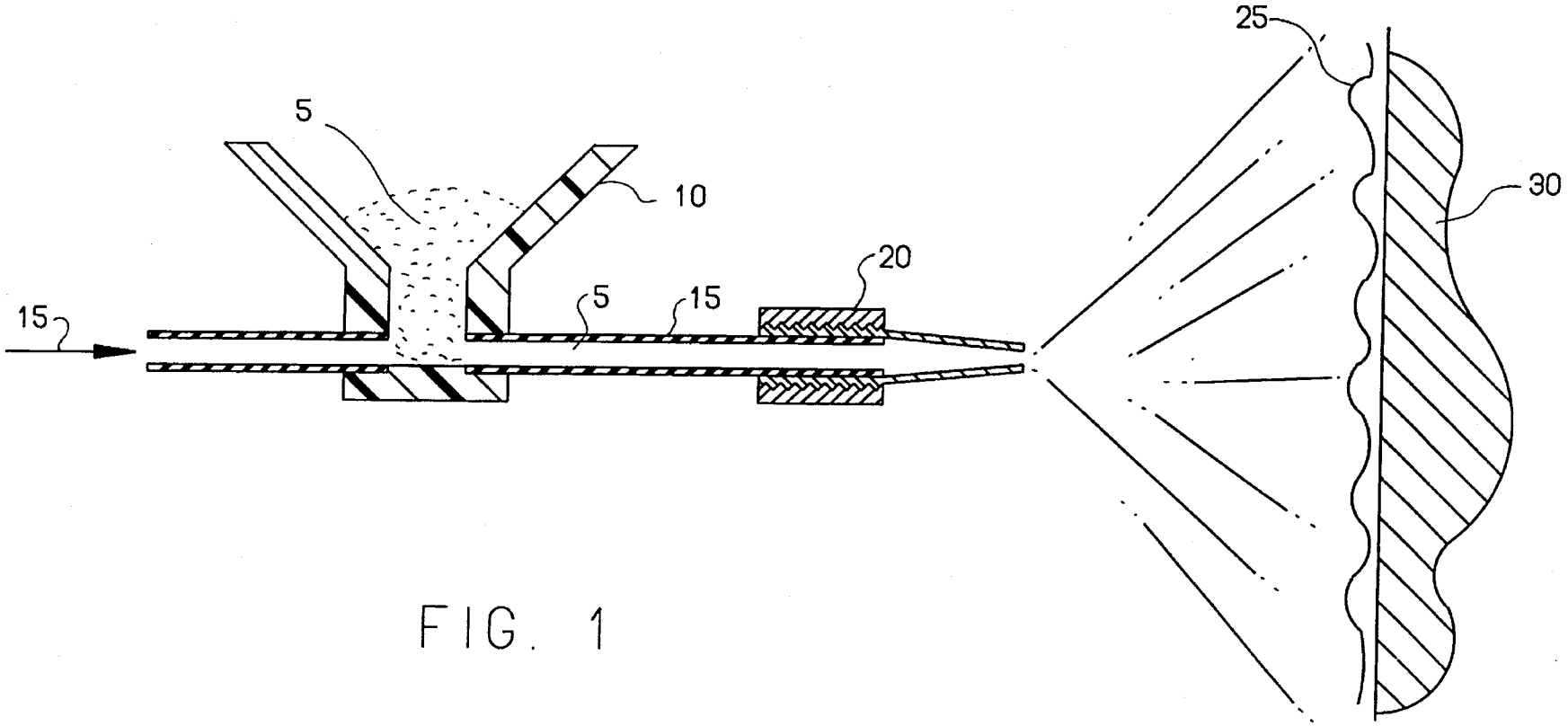
FIG. 1 shows a gunning system for applying the compositions of the invention to provide an expendable liner.

In accordance with the invention, a low density lining according to the invention is formed from a mixture which contains a refractory aggregate and a composition that includes a first component having at least one decomposable compound capable of producing gas when the first component decomposes. The composition further includes a second component having a reactable compound for reacting with the decomposable compound in the presence of liquid, preferably water, to cause the decomposable compound to generate a gaseous product. A sufficient amount of liquid is provided to the composition to enable the first and second components to react to internally generate gas in the composition to reduce the density of the composition.

The decomposable compound of the first component preferably is a material which, when added to water, yields a pH above 7. Materials useful as decomposable compounds include carbonates in which $CO_2$ can be evolved therefrom by a reactable component such as an acid. Useful carbonates include but are not limited to calcium carbonate, dolomitic carbonate, and the like. Reactable materials useful as the second component include cation type acids such as aluminum sulfate, chromium sulfate, citric acid, tartaric acid, and organic acids.

The particle size distribution of the decomposable compound of the first component depends on the method for applying the composition to a substrate. If the composition is applied by spraying, the particle size distribution of the decomposable compound, for example, calcium carbonate, is ≦8 mesh. If the composition is intended to be applied by gunning, the particle size of the decomposable compound such as calcium carbonate is ≦50 mesh, preferably ≦200 mesh.

The refractory aggregate employed may be an acidic, neutral, or basic water insoluble refractory such as olivine, silica, siliceous sand, chamotte, graphite, alumina, corundum, mullite, spinel, dolomite, magnesia, calcia, chromia, or zirconia as originated from brick or ore. The aggregate typically is present in the range of 45 to about 97% of the composition. The composition may be combined with at least one setting agent to increase the strength of the applied material. Useful setting agents include inorganic phosphates, lime, sodium acid phosphates, sodium silicate and the like, and mixtures thereof.

The low density expendable linings can be provided in a range of thicknesses depending on the application method used. Since the expendable lining formed by the invention has high strength as well as high porosity, the thickness of the lining can be reduced as compared with linings formed by conventional heat treating processes.

Useful non-limiting compositions illustrative of the types of inorganic materials and acids useful as the first and second components in the invention are given in Table 1.

TABLE 1

| Example No. | First Component (g) | Second Component (g) | Water (g) |
|---|---|---|---|
| 1 | Dolomitic Limestone (2.0) | Powdered Citric Acid (4.0) | 16.0 |
| 2 | Dolomitic Limestone (2.0) High CaO Limestone (2.0) | Powdered Citric Acid (8.0) | 24.0 |
| 3 | Dolomitic Limestone (2.0) High CaO Limestone (2.0) | Granular Citric Acid (4.0) | 16.0 |
| 4 | Dolomitic Limestone (2.0) High CaO Limestone (2.0) | Granular Citric Acid (8.0) | 24.0 |
| 5 | Dolomitic Limestone (2.0) High CaO Limestone (2.0) | Powdered Citric Acid (4.0) Granular Citric Acid (4.0) | 24.0 |
| 6 | High CaO Limestone (4.0) | Sulfamic Acid (4.0) | 16.0 |
| 7 | Dolomitic Limestone (2.0) | Sulfamic Acid (4.0) | 16.0 |
| 8 | Dolomitic Limestone (2.0) High CaO Limestone (2.0) | Sulfamic Acid (4.0) | 24.0 |
| 9 | Dolomitic Limestone (2.0) High CaO Limestone (2.0) | Malic Acid (4.0) | 16.0 |
| 10 | Albaglos[1] (4.0) | Oxalic Acid (4.0) | 16.0 |
| 11 | Dolomitic Limestone (2.0) | Oxalic Acid (4.0) | 12.0 |
| 12 | Dolomitic Limestone (2.0) | Oxalic Acid (2.0) | 16.0 |

[1]Precipitated calcium carbonate from Minerals Technologies Co., Inc., New York, New York.

EXAMPLES 13–24

Examples 13–24 illustrate various combinations of carbonate materials (first component) and acid (second component), and refractory aggregate useful in the invention.

TABLE 2

| Example No. | Refractory Aggregate(g) | Carbonate (g) | Acid(g) | Water(%) |
|---|---|---|---|---|
| 13 | Base mix[1] (94.0) | DF5025[2] (5.0) | PCA[5] (1.0) | 12.0 |
| 14 | Base mix[1] (94.0) | DF2055[3] (5.0) | PCA (1.0) | 12.0 |
| 15 | Base mix[1] (93.0) | DF5025 (5.0) | PCA (1.0) | 12.0 |
| 16 | Base mix[1] (93.0) | DF2055 (5.0) | PCA (2.0) | 12.0 |
| 17 | Base mix[1] (93.0) | MS LIME[4] (5.0) | PCA (2.0) | 12.0 |
| 18 | Base mix[1] (92.0) | DF5025 (5.0) | PCA (3.0) | 12.0 |
| 19 | Base mix[1] (92.0) | DF2055 (5.0) | PCA (3.0) | 12.0 |
| 20 | Base mix[1] (91.0) | DF5025 (5.0) | PCA (4.0) | 12.0 |
| 21 | Base mix[1] (91.0) | DF2055 (5.0) | PCA (4.0) | 12.0 |
| 22 | Base mix[1] (94.0) | DF2055 (5.0) | GCA[6] (1.0) | 12.0 |
| 23 | Base mix[1] (93.0) | DF5025 (5.0) | GCA (2.0) | 12.0 |
| 24 | Base mix[1] (93.0) | MS LIME (5.0) | GCA (2.0) | 12.0 |

[1]Mixture of 21.5% Chinese 9010 MgO, 8 × 18 m; 41.3% Chinese 9010 MgO, −18 m; 26.7% Chinese 9010 MgO, pulverized; 7.9% Ube MgO, pulverized; 2.1% Bentonite, 0.5% Calcium Ligno Sulfonate.
[2]DF5025 = Dolofill 5025 limestone, from Minerals Technologies, New York, New York.
[3]DF2055 = Dolofill 2055 limestone, from minerals Technologies, New York, New York.
[4]MS Lime = $Ca(OH)_2$
[5]PCA = Powdered citric acid
[6]GCA = Granular citric acid

EXAMPLES 25–38

Examples 25–38 illustrate the effects of varying the amount of granular citric acid (second component) with varying size of MW Limestone (first component).

TABLE 3

| Example No. | Refractory Aggregate (g) | MW Limestone[2] (g) | Granular Citric Acid (g) | Water % |
|---|---|---|---|---|
| 25 | 94.0 | +50 mesh 5.0 | 1.0 | 20.0 |
| 26 | 94.0 | 50 × 100 mesh 5.0 | 1.0 | 22.0 |
| 27 | 94.0 | 50 × 200 mesh 5.0 | 1.0 | 22.0 |
| 28 | 94.0 | 50 × 325 mesh 5.0 | 1.0 | 22.0 |
| 29 | 93.0 | +50 mesh 5.0 | 2.0 | 22.0 |
| 30 | 93.0 | 50 × 100 mesh 5.0 | 2.0 | 22.0 |
| 31 | 93.0 | 50 × 200 mesh 5.0 | 2.0 | 22.0 |
| 32 | 93.0 | 50 × 325 mesh 5.0 | 2.0 | 22.0 |
| 33 | 92.0 | +50 mesh 5.0 | 3.0 | 22.0 |
| 34 | 92.0 | 50 × 100 mesh 5.0 | 3.0 | 22.0 |
| 35 | 92.0 | 50 × 200 mesh 5.0 | 3.0 | 22.0 |
| 36 | 92.0 | 50 × 325 mesh 5.0 | 3.0 | 22.0 |
| 37 | 91.0 | +50 mesh 5.0 | 4.0 | 22.0 |
| 38 | 91.0 | 50 × 100 mesh 5.0 | 4.0 | 22.0 |

[1]Mixture of 21.5% Chinese 9010 MgO, 8 × 18 m; 41.3% Chinese 9010 MgO, −18 m; 25.7% Chinese 9010 MgO, pulverized; 7.9% Ube MgO, pulverized; 2.1% Bentonite, 0.5% Calcium Ligno Sulfonate; 1.0% coarse paper fibers.
[2]MW Limestone = marble white limestone from Minerals Technologies, New York, New York.

EXAMPLES 39–50

Examples 39–50 illustrate various compositions useful for providing low density expendable linings in accordance with the invention. Each of these compositions are prepared by hand mixing.

The method of providing and applying the compositions of the invention to provide an expendable liner will now be explained in detail by reference to the drawings where like numerals indicate like components.

In FIG. 1, a gunning system 1 for applying the compositions of invention to a vertical substrate such as the permanent lining of tundish to form an expendable liner thereon is shown. As shown therein, composition 5 of the invention that includes the aforementioned first and second components, and which is substantially free of water is provided in feed hopper 10. Composition 5 is transported by pressurized air provided to end portion 15A of hose 15 by a compressed air generator (not shown). The pressurized air forces composition 5 to move through hose 15 to contact a substrate 30 such as the permanent lining of a tundish to form expendable lining 25 thereon. Prior to exiting hose 15, however, composition 5 is contacted by water distributed by water ring nozzle 20 on hose 15 to achieve a moisture content of 10–15% in composition 5 prior to contacting substrate 30. The aforesaid first and second components of composition 5, after having been formed into a layer on substrate 30, react in the presence of the moisture provided by water ring nozzle 20 to generate a gas within the layer causing the material to expand to thereby yield a porous, green liner. The porous, green liner is dried prior to exposure to high temperature corrosive environments such as those produced by steel.

Figure 2:
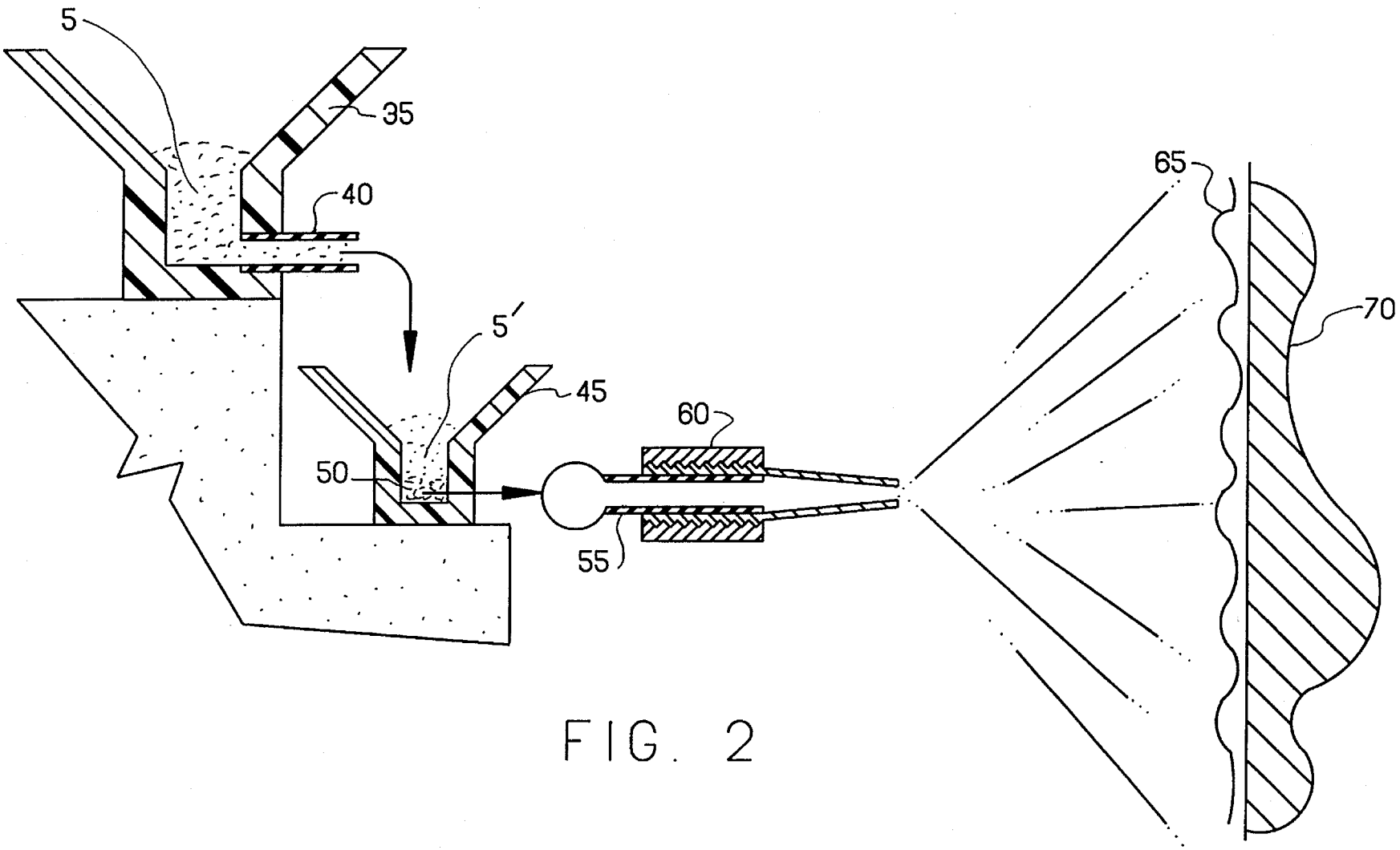
FIG. 2 shows a spraying system for applying the compositions of the invention to provide an expendable liner.

In an alternative embodiment as shown in FIG. 2, spraying system 2 may be used to produce an expendable lining formed from the compositions of the invention. As shown in FIG. 2, composition 5 of the invention that includes the aforementioned first and second components, and which is substantially free of water is provided in feed hopper 35 for supply to wet mixing chamber 40 wherein water provided by a water source (not shown) is added to composition 5 to achieve a moisture content of 20–30%. The resulting moist composition 5' is transported to mixing/feed chamber 45. Mixing/feed chamber 45 is provided with feed screw 50 for mixing and feeding of composition 5' through supply hose 55 to air injector nozzle 60. Composition 5' exits nozzle 60 for spraying against wall 70 to form lining 65. The aforesaid

TABLE 4

| Example/ Material (%) | 39 | 40 | 41 | 42 | 43 | 44 | 45 | 46 | 47 | 48 | 49 | 50 |
|---|---|---|---|---|---|---|---|---|---|---|---|---|
| MB3-1[3] | — | 95.0[1] | 93.0[1] | — | 92.5[1] | — | 91.5[1] | — | 92.0 | 91.5 | 92.0 | 91.5 |
| MB1-3[4] | 95.0[1] | — | — | 93.0[1] | — | 92.5[1] | — | 91.5[1] | | | | |
| Bentonite | — | | 2.0[1] | 2.0[1] | 2.0[1] | 2.0[1] | 2.0[1] | 2.0[1] | 2.0 | 2.0 | — | — |
| Pwd. Al. Sulfate | 2.5[1] | 2.5[1] | 2.5[1] | 2.5[1] | 2.5[1] | 2.5[1] | 2.5[1] | 2.5[1] | 2.5 | 3.0 | 2.5 | 3.0 |
| MW Limestone[5] (−325m) | 2.5[1] | 2.5[1] | 2.5[1] | 2.5[1] | 2.5[1] | 2.5[1] | 2.5[1] | 2.5[1] | 3.0 | 3.0 | 3.0 | 3.0 |
| Monocalcium Phosphate | — | — | — | — | 0.5[1] | 0.5[1] | 0.5[1] | 0.5[1] | 0.5 | 0.5 | 0.5 | 0.5 |
| Coarse Paper Fibers | — | — | — | — | — | — | 1.0[1] | 1.0[1] | — | — | — | — |
| Water | 26[2] | 15[2] | 15[2] | 26[2] | 15[2] | 26[2] | 20[2] | 30[2] | 15 | 15 | 15 | 15 |
| Set Time Minutes | 1.5 | .25 | .25 | 2.0 | .25 | 2.5 | 2 | 3.5 | .167 | .167 | .167 | .167 |
| Aluminum Hydrate | — | — | — | — | — | — | — | — | — | — | 2.0 | 2.0 |
| Density (lb/ft$^3$) | 96.4 | 82.1 | — | — | — | — | — | — | — | 77.9 | 89.2 | 78.0 |

[1]% by weight of Total Solids
[2]% by weight of overall composition
[3]Refractory Aggregate of Composition of 25% Chinese 9010 MgO, 8 × 18 m; 35% Chinese 9010 MgO, −18 m; and 40% Chinese 9010 MgO, pulverized.
[4]Refractory Aggregate of Composition of 100% Ube 95 MgO, −40 mesh.
[5]MW Limestone = marble white limestone from Minerals Technologies, New York, New York.

first and second components of composition 5', after having been formed into a layer on wall 70, react to generate a gas within the layer to thereby yield a porous, green liner. The porous, green liner is dried prior to exposure to high temperature corrosive environments such as those produced by molten steel.

In an alternative embodiment of spraying system 2, the second component containing a reactable compound may be added to the first component while the first component is transported through hose 15. The second component can be supplied to the first component in the hose through, for example, a valve (not shown) positioned on the side of hose 15. Such valves are known in the art. The amount of the reactable compound in the second component can be determined from stoichiometry to yield the desired extent of reaction of the first and second components. The specific pressures required to spray or gun the compositions of the invention onto the substrate also can readily be determined by the art skilled.

Without further elaboration, it is believed that one skilled in the art can, using the preceding description, utilize the present invention to its fullest extent.

What is claimed is:

1. A composition suitable for providing a low density refractory material for molten metal handling devices comprising a refractory material which includes at least two substantially dry components, wherein the first component comprises at least one decomposable compound capable of producing gas when said decomposable compound decomposes, and the second component comprises a reactable compound of a cationic acid or an organic acid for reacting with said decomposable compound in the presence of water to cause said decomposable compound to generate the gas to provide said low density refractory material.

2. The composition of claim 1 further including a refractory aggregate.

3. The composition of claim 1 wherein said gas is carbon dioxide.

4. The composition of claim 3 wherein said decomposable compound is a carbonate compound.

5. The composition of claim 1 wherein said decomposable compound is selected from the group of sodium bicarbonate, barium carbonate, calcium carbonate and dolomitic carbonate.

6. The composition of claim 3 wherein said reactable compound is a powdered or granular organic acid.

7. The composition of claim 5 wherein said reactable compound is aluminum sulfate, chromium sulfate, citric acid, malic acid, oxalic acid, sulfamic acid or tartaric acid.

8. The composition of claim 5 wherein said reactable compound is aluminum sulfate

9. The composition of claim 8 wherein said decomposable compound is calcium carbonate and is present in an amount of about 1–5 percent by weight of the composition.

10. The composition of claim 9 wherein said reactable compound is aluminum sulfate and is present in an amount of about ⅓ to ⅔ times that of the decomposable compound.

11. The composition of claim 10 which further comprises a refractory aggregate, wherein said refractory aggregate is selected from the group consisting of olivine, silica, siliceous sand, chamotte, graphite, alumina, corundum, mullite, spinel, dolomite, magnesia, calcia, chromia, or zirconia and mixtures thereof.

12. The composition of claim 10 wherein the refractory aggregate is magnesia.

13. A method of producing a low density refractory material on a molten metal handling vessel which comprises:

providing a composition of a refractory material which includes a first component comprising at least one substantially dry decomposable compound capable of producing gas when said decomposable compound decomposes, and a second substantially dry component comprising a reactable compound of a cationic acid or an organic acid for reacting with said decomposable compound in the presence of water to cause said decomposable compound to generate the gas to provide said low density refractory material;

mixing water with the composition in or adjacent the spray nozzle of a system for gunning or spraying refractory material to form a gunnable or sprayable mixture, and applying said composition to said substrate by spraying or gunning the mixture through the spray nozzle to produce the low density refractory material as a lining thereon.

14. The low density material produced by the method of claim 13.

15. The method of claim 13 wherein the reactable compound is a sulfate or a powdered or granular organic acid.

16. The method of claim 13 wherein the reactable compound is aluminum sulfate, chromium sulfate, citric acid, malic acid, oxalic acid, sulfamic acid or tartaric acid.

17. The method of claim 13 wherein the decomposable compound is aluminum sulfate, calcium lignosulfonate, calcium carbide, a carbonate compound or a metal powder.

18. The method of claim 17 wherein the carbonate compound is sodium bicarbonate, barium carbonate, calcium carbonate and dolomitic limestone.

19. The method of claim 13 wherein the composition further comprises a refractory aggregate.

20. The composition of claim 1 wherein the decomposable compound is aluminum sulfate, calcium lignosulfonate, calcium carbide, a carbonate compound or a metal powder.

21. A composition suitable for providing a low density refractory material comprising a refractory material which includes at least two substantially dry components, wherein the first component comprises at least one decomposable carbonate compound capable of producing $CO_2$ gas when said decomposable compound decomposes; and the second component comprises a reactable compound of a sulfate or an organic acid for reacting with said decomposable compound in the presence of water to cause said decomposable compound to generate the $CO_2$ gas to provide said low density refractory material.

22. The composition of claim 21 wherein the reactable compound is a powdered or granular organic acid.

23. The composition of claim 21 wherein the reactable compound is aluminum sulfate, chromium sulfate, citric acid, malic acid, oxalic acid, sulfamic acid or tartaric acid.

24. The composition of claim 21 wherein the decomposable carbonate compound is sodium bicarbonate, barium carbonate, calcium carbonate and dolomitic limestone.

25. The composition of claim 21 wherein the composition further comprises a refractory aggregate.

26. A method of producing a low density refractory material on a molten metal handling vessel which comprises:

providing first and second components, each of which is substantially dry, wherein the first component comprises at least one decomposable compound capable of producing gas when said decomposable compound decomposes, and the second component comprises a reactable compound of a cationic acid or an organic acid for reacting with said decomposable compound in the presence of water to cause said decomposable compound to generate the gas to provide said low density refractory material;

forming a mixture of the first component, the second component, and water in or near the spray nozzle of a system for spraying or gunning, and applying said mixture to a molten metal handling vessel by spraying or gunning through the spray nozzle to produce a low density refractory material as a lining thereon.

27. The method of claim 26, which further comprises combining the first component with the second component before forming said mixture.

28. The method of claim 26, wherein the first and second components are separately mixed with water before the second component is added to the first component to form said mixture.

* * * * *